US007059883B2

(12) United States Patent
Tsai

(10) Patent No.: US 7,059,883 B2
(45) Date of Patent: Jun. 13, 2006

(54) ELECTRICAL CONNECTOR CAPABLE OF MOVING A CIRCUIT BOARD IN A REVERSE DIRECTION TO AN INSERTING DIRECTION BY A DISTANCE

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 35 days.

(21) Appl. No.: 10/761,603

(22) Filed: Jan. 20, 2004

(65) Prior Publication Data

US 2004/0152352 A1 Aug. 5, 2004

(51) Int. Cl.
*H01R 13/62* (2006.01)

(52) U.S. Cl. ..... 439/326; 439/495

(58) Field of Classification Search ..... 439/325, 439/326 I, 495, 637
See application file for complete search history.

(56) References Cited

U.S. PATENT DOCUMENTS 5,437,560 A * 8/1995 Mizuguchi ..... 439/326
5,567,171 A * 10/1996 Mizuguchi ..... 439/326
5,695,353 A * 12/1997 Sakata et al. ..... 439/326
5,807,128 A * 9/1998 Sakata et al. ..... 439/326
5,836,780 A * 11/1998 Mizumura et al. ..... 439/326
6,174,187 B1 * 1/2001 Yamagami et al. ..... 439/326
6,176,723 B1 * 1/2001 Sakata et al. ..... 439/326
6,176,725 B1 * 1/2001 Kobayashi et al. ..... 439/326

* cited by examiner

*Primary Examiner*—Thanh-Tam Le
(74) *Attorney, Agent, or Firm*—Pro-Techtor Int'l Services

(57) ABSTRACT

An electrical connector includes an insulation base, and first and second terminals arranged in the base. The base has a connection slot, into which a circuit board may be inserted. The slot has an upper edge formed with a slant first surface and a horizontal second surface, and a lower edge formed with a horizontal third surface and a fourth surface, wherein an inner side of the slot is formed with a fifth surface. Each first terminal has an elastic contact having a connection point projecting over the second surface in the slot. Each second terminal has an elastic contact having a connection point projecting over the third surface in the slot. The card-ejecting slant surface is formed between the second and fifth surfaces. The inserted circuit board is moved backward by a distance along the card-ejecting slant surface when the circuit board is rotated to be horizontal.

7 Claims, 7 Drawing Sheets

ELECTRICAL CONNECTOR CAPABLE OF MOVING A CIRCUIT BOARD IN A REVERSE DIRECTION TO AN INSERTING DIRECTION BY A DISTANCE

BACKGROUND OF THE INVENTION

1. Field of the Invention

The invention relates to an electrical connector, and more particularly to an electrical connector capable of moving a circuit board in a reverse direction to an inserting direction by a distance.

2. Description of the Related Art

Referring to FIG. 1, a conventional electrical connector includes an insulation base 10 formed with a connection slot 11 into which a circuit board 1 may be inserted. The connection slot 11 has an upper edge formed with, from outside to inside, a slant first surface 12 and a horizontal second surface 13, and a lower edge formed with, from outside to inside, a horizontal third surface 14 and a fourth surface 15 that is slant in correspondence with the first surface 12. An inner side of the connection slot 11 is formed with a vertical fifth surface 16. The upper edge of the connection slot 11 is formed with a plurality of spaced first spacers 17 so as to form a plurality of spaced first terminal receiving slots 18. The lower edge is formed with a plurality of spaced second spacers 19 so as to form a plurality of spaced second terminal receiving slots 20.

A plurality of first terminals 25 is mounted into the insulation base 10. Each first terminal 25 has an elastic contact 26 that may be elastically moved in the first terminal receiving slot 18. The contact 26 has a protrudent connection point 27 projecting over the second surface 13 and located within the connection slot 11.

A plurality of second terminals 30 is mounted into the insulation base 10. Each second terminal 30 has an elastic contact 31 that may be elastically moved in the second terminal receiving slot 20. The contact 31 has a protrudent connection point 32 projecting over the third surface 14 and located within the connection slot 11.

According to the above-mentioned structure, as shown in FIG. 2, the circuit board 1 may be slantly inserted into the connection slot 11 along the first surface 12. At this time, a point A on the top surface 2 of the circuit board is in contact with the connection point 27 of the first terminal 25, and a point C on the bottom surface 3 of the circuit board is in contact with the connection point 32 of the second terminal 30. Hence, the portion in front of the point A on the top surface 2 of the circuit board rubs against the first terminal 25 so as to remove the oxidation layer thereon. Similarly, the portion in front of the point C on the bottom surface 3 of the circuit board rubs against the second terminal 30 so as to remove the oxidation layer thereon.

As shown in FIG. 3, when the circuit board 1 is pressed and rotated to be horizontal and electrically connected to the first and second terminals 25 and 30, the top and bottom surfaces 2 and 3 of the circuit board are in contact with the second and third surfaces 13 and 14, respectively. At this time, the top surface 2 of the circuit board is moved backward to connect the connection point 27 at a contact point B, and the bottom surface 3 of the circuit board is moved forward to connect the connection point 32 at a contact point D.

The conventional structure has the following drawbacks. As shown in FIG. 3, when the circuit board 1 is pressed to be horizontal and electrically connected to the first and second terminals 25 and 30, the bottom surface 3 of the circuit board is moved forward to connect the connection point 32 at the contact point D. However, the oxidation layer at the point D is not removed when the circuit board of FIG. 2 is inserted. Thus, the electrical connection effect is poor.

SUMMARY OF THE INVENTION

It is therefore an object of the invention to provide an electrical connector capable of moving a circuit board in a reverse direction to an inserting direction by a distance so that a better electrical connection effect may be obtained.

The invention achieves the above-identified object by providing an electrical connector, into which a circuit board may be inserted. The electrical connector includes an insulation base, a plurality of first terminals arranged in the insulation base, and a plurality of second terminals arranged in the insulation base. The insulation base has a connection slot, into which the circuit board is inserted. The connection slot has an upper edge formed with, from outside to inside, a slant first surface and a horizontal second surface, and a lower edge formed with, from outside to inside, a horizontal third surface and a fourth surface. An inner side of the connection slot is formed with a fifth surface. Each of the first terminals has an elastic contact, which has a protrudent connection point projecting over the second surface and located within the connection slot. Each of the second terminals has an elastic contact, which has a protrudent connection point projecting over the third surface and located within the connection slot. A card-ejecting slant surface is formed between the second surface and the fifth surface in the connection slot, and the inserted circuit board is moved backward by a distance along the card-ejecting slant surface when the circuit board is rotated to be horizontal.

The invention utilizes the card-ejecting slant surface to move the inserted circuit board backward by a distance such that the oxidation layers on two surfaces of the circuit board may be effectively scratched and removed by the connection points. Thus, a better electrical connection effect may be obtained.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
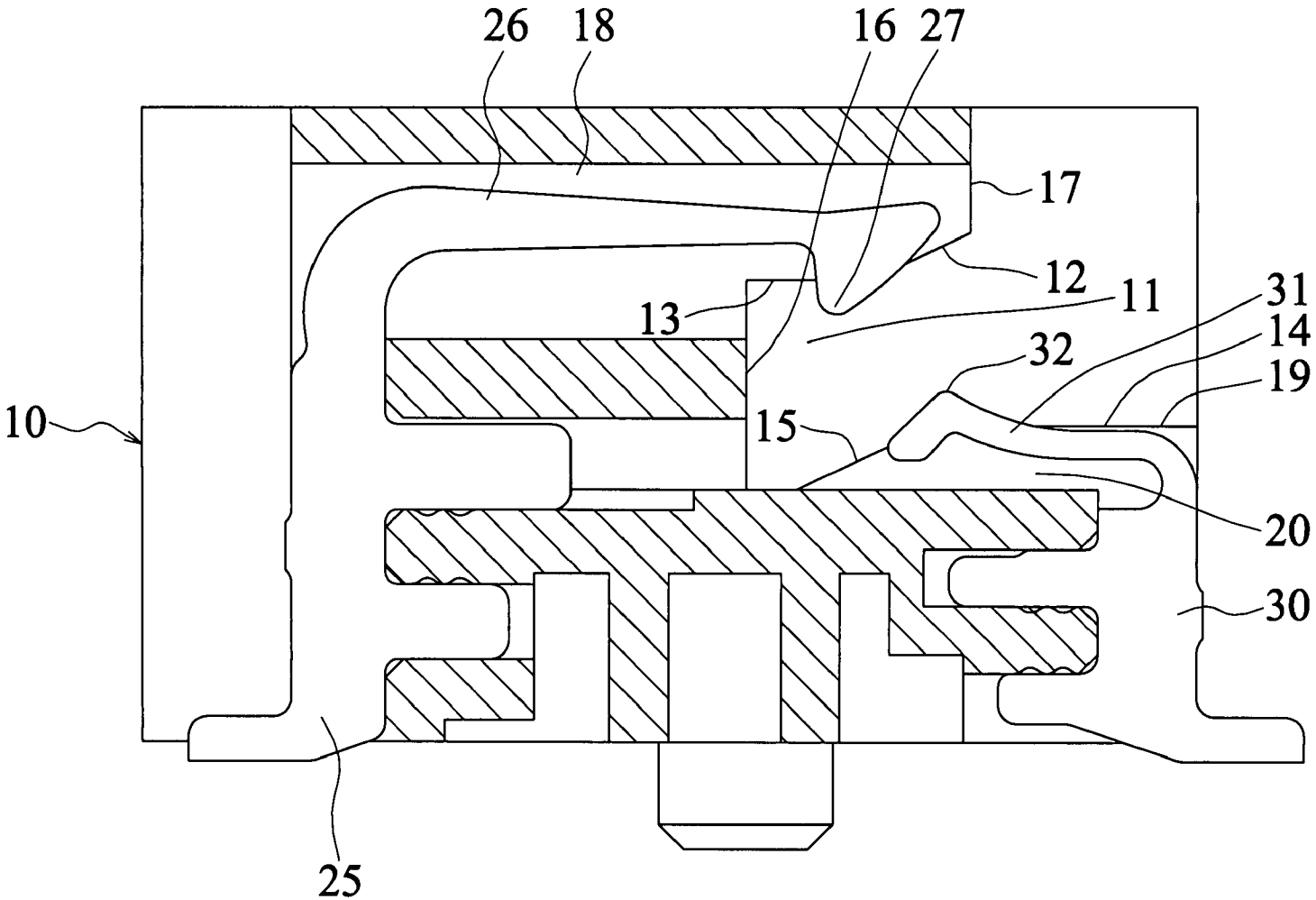
FIG. 1 (Prior Art)
FIG. 1 is a schematically cross-sectional view showing a conventional electrical connector.
Figure 2:
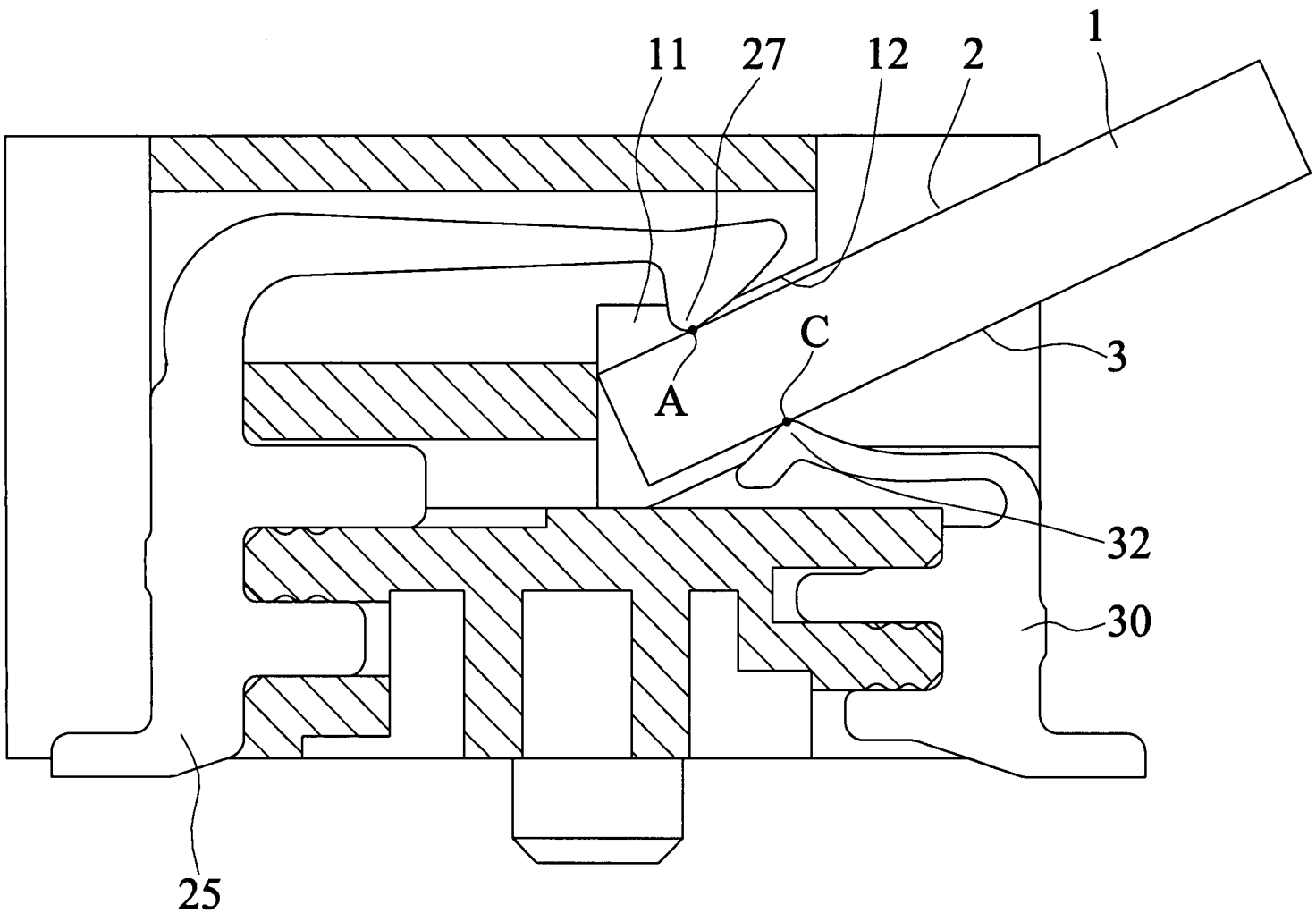
FIG. 2 (Prior Art)
FIG. 2 is a schematically cross-sectional view showing the conventional electrical connector into a circuit board is slantly inserted.
Figure 3:
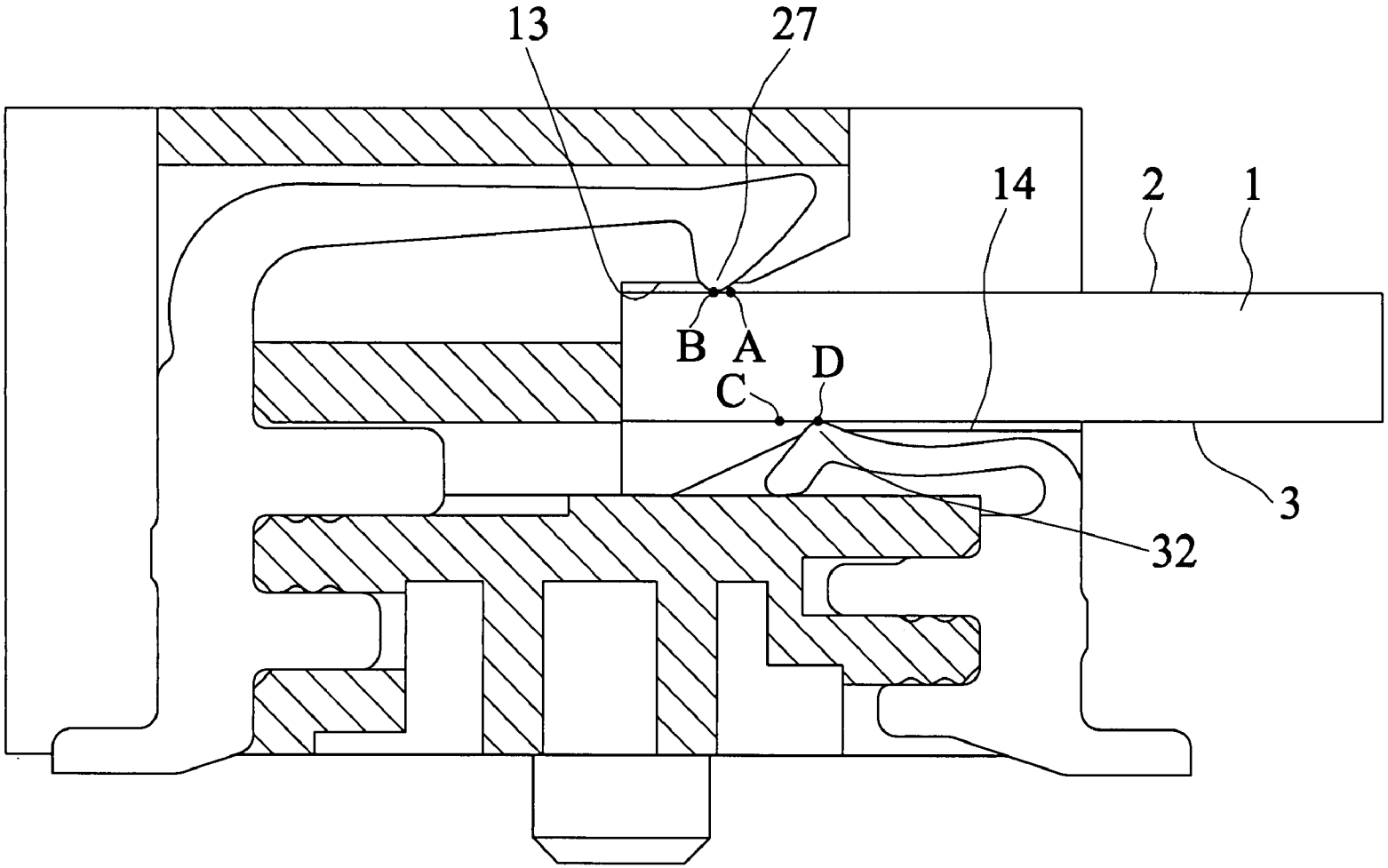
FIG. 3 (Prior Art)
FIG. 3 is a schematically cross-sectional view showing the conventional electrical connector after the circuit board is pressed to be horizontal.
Figure 4:
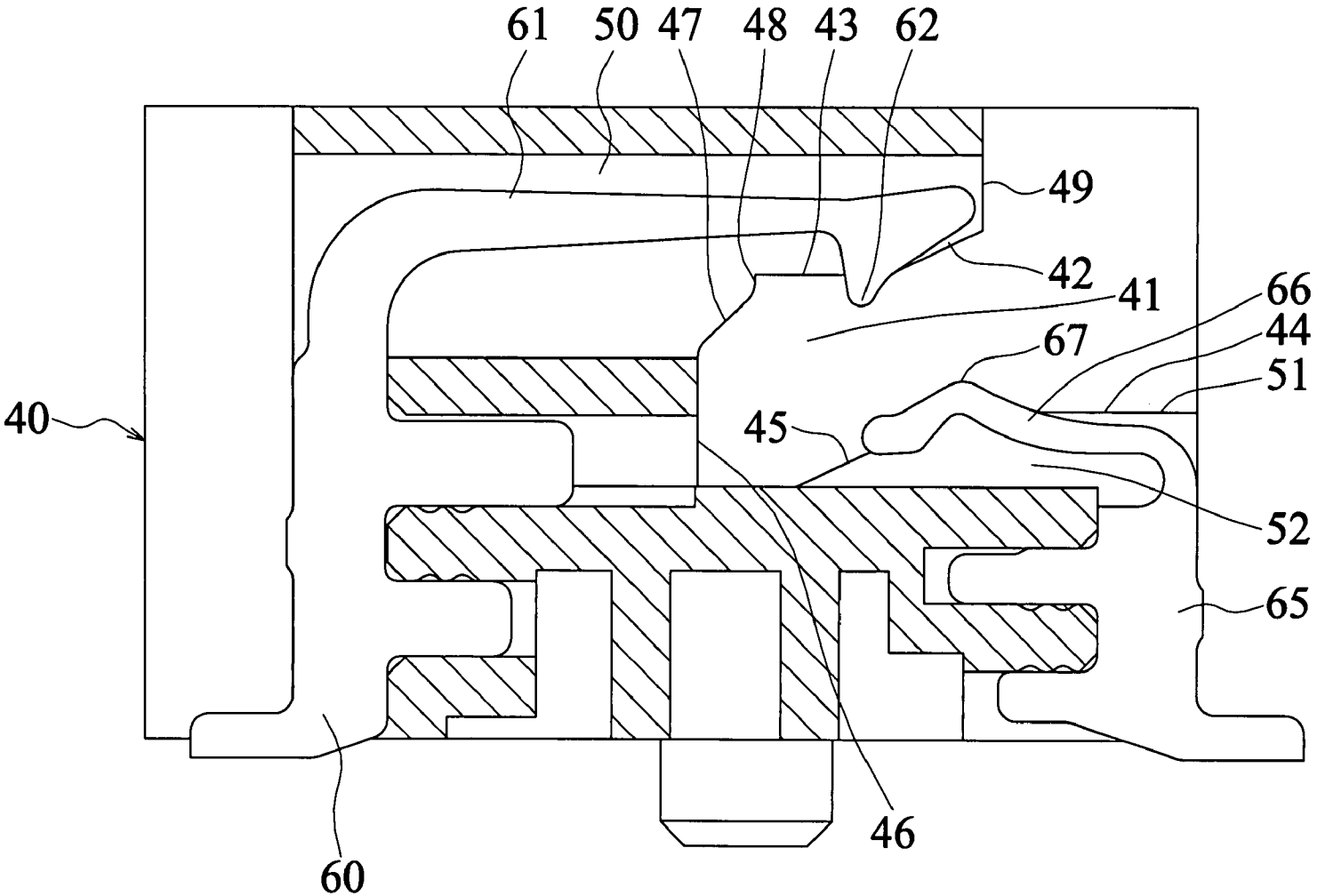
FIG. 4 is a schematically cross-sectional view showing a first embodiment of the invention.

Referring to FIG. 4, an electrical connector of the invention includes an insulation base 40, a plurality of first terminals 60 and a plurality of second terminals 65.

The insulation base 40 has a connection slot 41 into which a circuit board may be inserted frontward. The connection slot 41 has an upper edge formed with, from outside to inside, a slant first surface 42 and a horizontal second surface 43, and a lower edge formed with, from outside to inside, a horizontal third surface 44 and a fourth surface 45 that is slant in correspondence with the first surface 42. An inner side of the connection slot 41 is formed with a vertical fifth surface 46. A card-ejecting slant surface 47 is formed between the fifth surface 46 and the second surface 43, and a vertical sixth surface 48 is formed between the card-ejecting slant surface 47 and the second surface 43. The upper edge of the connection slot 41 is formed with a plurality of spaced first spacers 49 so as to form a plurality of spaced first terminal receiving slots 50. The lower edge is formed with a plurality of spaced second spacers 51 so as to form a plurality of spaced second terminal receiving slots 52.

The plurality of first terminals 60 is mounted into the insulation base 40. Each first terminal 60 has an elastic contact 61 that may be elastically moved in the first terminal receiving slot 50. The contact 61 has a protrudent connection point 62 projecting over the second surface 43 and located within the connection slot 41.

The plurality of second terminals 65 is mounted into the insulation base 40. Each second terminal 65 has an elastic contact 66 that may be elastically moved in the second terminal receiving slot 52. The contact 66 has a protrudent connection point 67 projecting over the third surface 44 and located within the connection slot 41.

Figure 5:
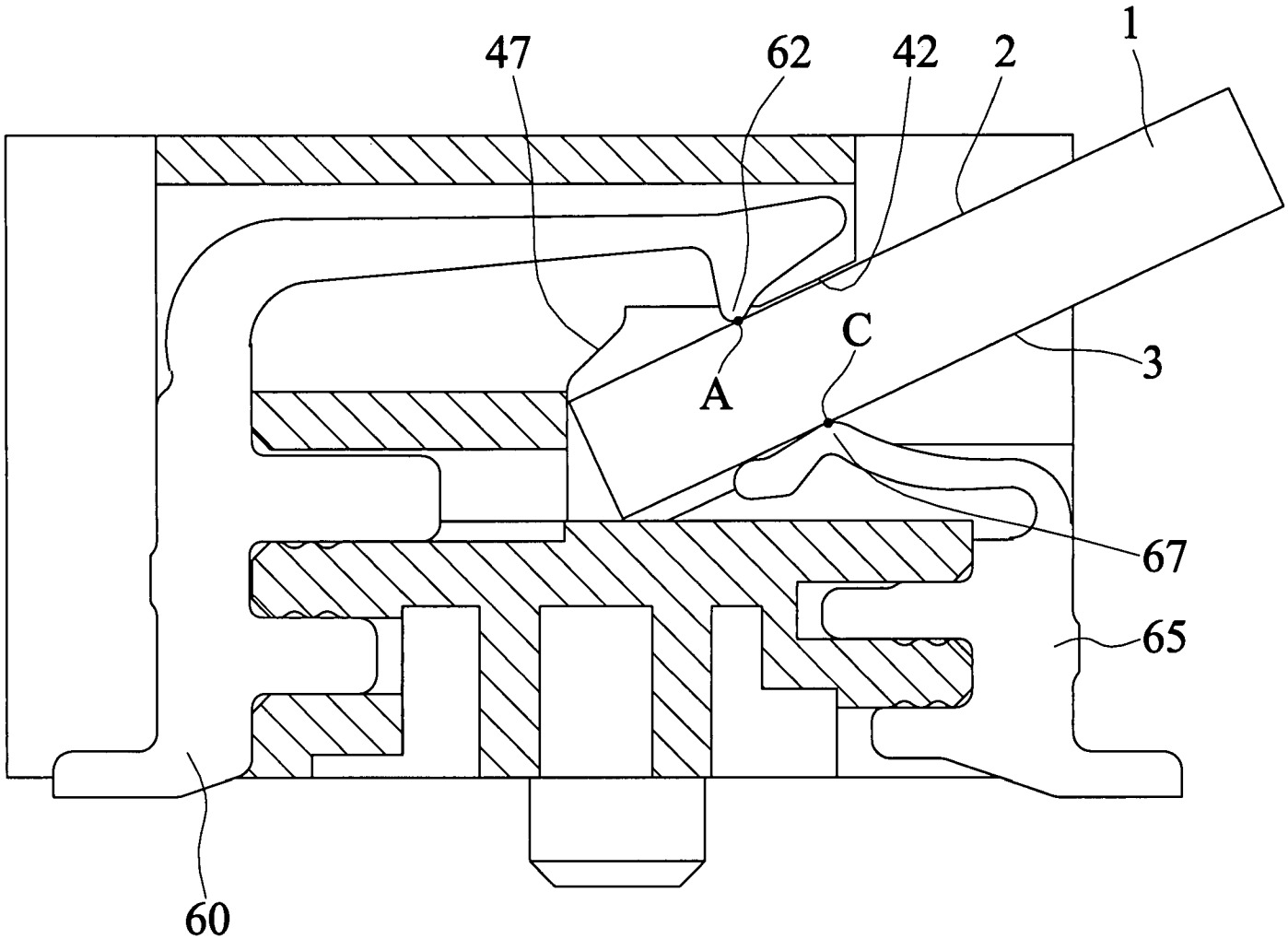
FIG. 5 is a schematically cross-sectional view showing the first embodiment of the invention into which a circuit board is inserted.

According to the above-mentioned structure, as shown in FIG. 5, when the circuit board 1 is slantly inserted into the connection slot 41 along the first surface 42, a point A on the top surface 2 of the circuit board is in contact with the connection point 62 of the first terminal 60, and a point C on the bottom surface 3 of the circuit board is in contact with the connection point 67 of the second terminal 65. Hence, the portion in front of the point A on the top surface of the circuit board rubs against the first terminal 60 so as to remove the oxidation layer thereon. Similarly, the portion in front of the point C on the bottom surface 3 of the circuit board rubs against the second terminal 65 so as to remove the oxidation layer thereon.

Figure 6:
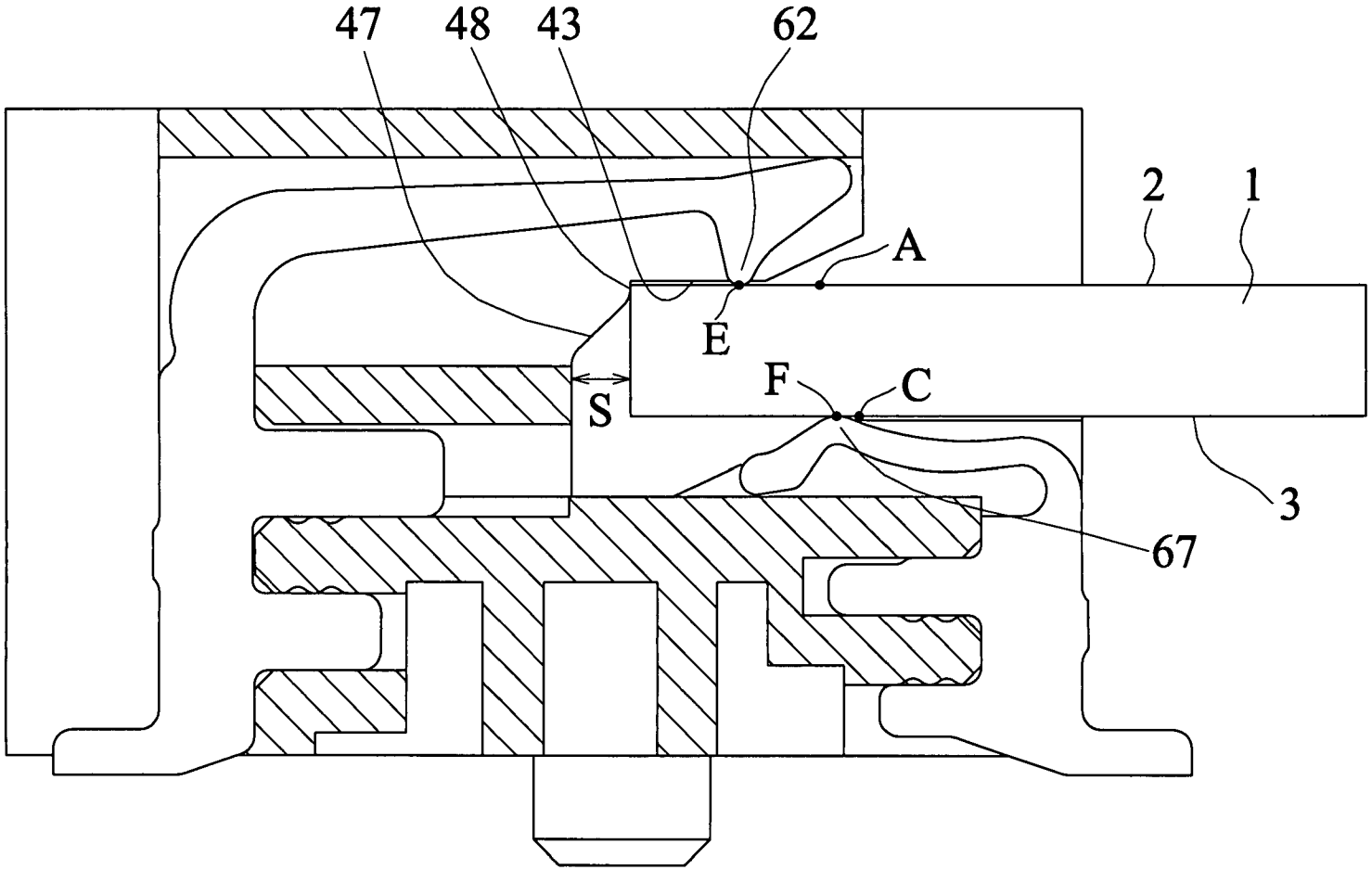
FIG. 6 is a schematically cross-sectional view showing the first embodiment of the invention after the circuit board is pressed to be horizontal.

As shown in FIG. 6, when the circuit board 1 is pressed and rotated to be horizontal and electrically connected to the first and second terminals 60 and 65, the front end of the circuit board 1 is rotated to be horizontal along the card-ejecting slant surface 47, such that the top and bottom surfaces 2 and 3 of the circuit board are in contact with the second and third surfaces 43 and 44, respectively. The circuit board 1 is pushed by the card-ejecting slant surface 47 and thus moved backward by a distance S, and the top surface 2 of the circuit board is moved backward to connect the connection point 62. Thus, the total backward moving distance of the circuit board will be lengthened and a contact point E between the top surface of the circuit board and the terminal is in front of the point A and the distance from the point E to the point A becomes longer. Thus, the oxidation layer may be effectively removed so that a good electrical connection effect may be obtained. Although the bottom surface 3 of the circuit board is originally moved forward to connect the connection point 67, a contact point F is in front of the point C because the backward moving distance S is longer than the forward moving distance.

In addition, after the circuit board 1 is rotated to be horizontal, its front end may be still in contact with the vertical sixth surface 48. Thus, the circuit board may be stably positioned.

The invention utilizes the card-ejecting slant surface 47 to move the inserted circuit board backward by a distance such that the oxidation layers on two surfaces of the circuit board may be effectively scratched and removed by the connection points. Thus, a better electrical connection effect may be obtained.

Figure 7:
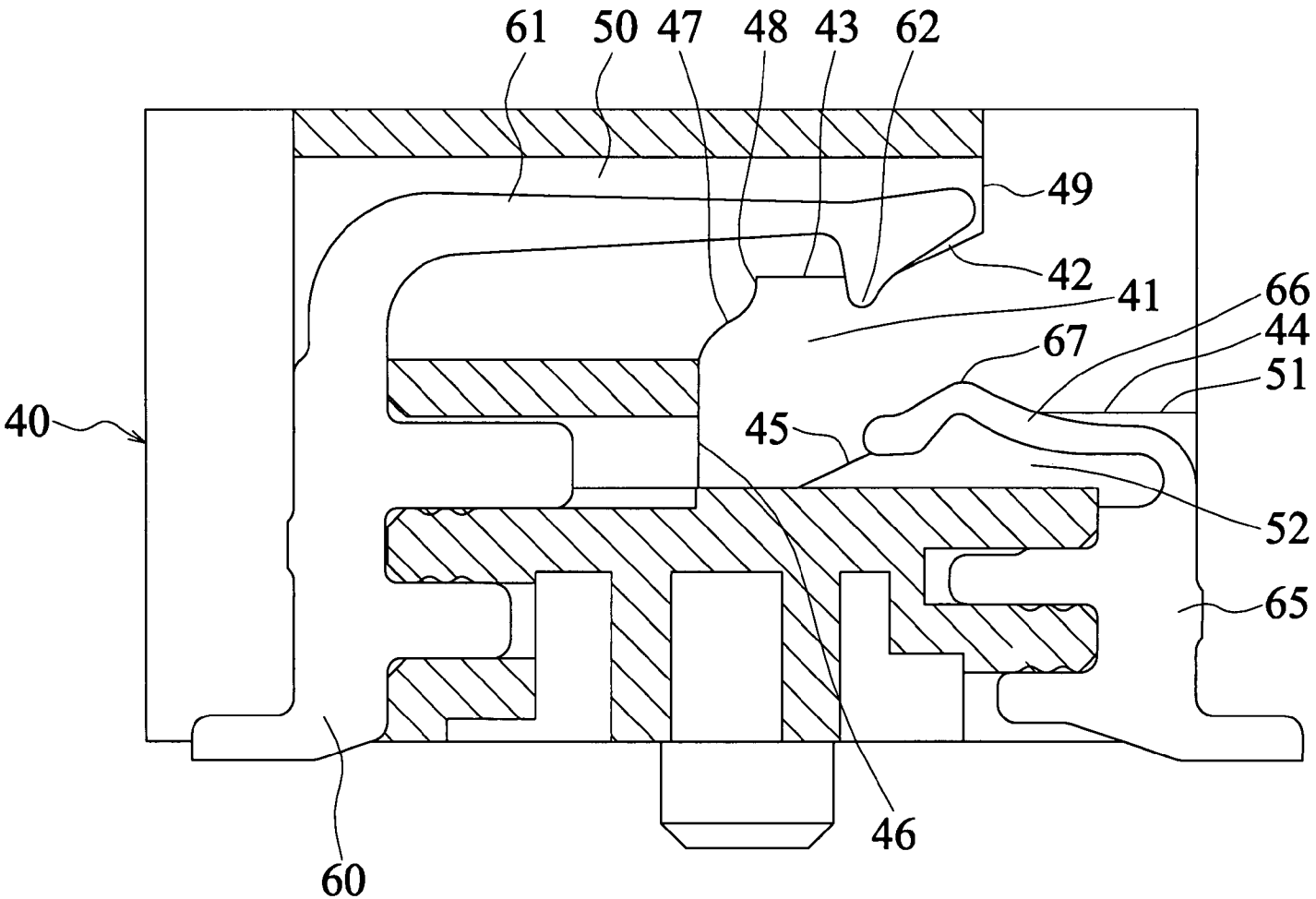
FIG. 7 is a schematically cross-sectional view showing a second embodiment of the invention.

As shown in FIG. 7, the electrical connector according to a second embodiment of the invention has a card-ejecting slant surface 47 that is an arced slant surface.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An electrical connector, into which a circuit board may be inserted frontward, the electrical connector comprising:

an insulation base having a connection slot, into which the circuit board is inserted, the connection slot having an upper edge formed with, from outside to inside, a slant first surface and a horizontal second surface, and a lower edge formed with, from outside to inside, a horizontal third surface and a fourth surface, wherein an inner side of the connection slot is formed with a fifth surface;

a plurality of first terminals arranged in the insulation base, each of the first terminals having an elastic contact, which has a protrudent connection point projecting over the second surface and located within the connection slot; and a plurality of second terminals arranged in the insulation base, each of the second terminals having an elastic contact, which has a protrudent connection point projecting over the third surface and located within the connection slot, wherein a card-ejecting slant surface is formed between the second surface and the fifth surface in the connection slot, and the inserted circuit board is relatively pushed by the card-ejecting slant surface and thus moved backward by a distance along the card-ejecting slant surface when the circuit board is rotated to be horizontal.

2. The electrical connector according to claim 1, wherein the fifth surface is a vertical surface.

3. The electrical connector according to claim 1, wherein a vertical sixth surface is formed between the card-ejecting slant surface and the second surface.

4. The electrical connector according to claim 1, wherein the card-ejecting slant surface is an arced slant surface.

5. The electrical connector according to claim 1, wherein the fourth surface is a slant surface corresponding to the slant first surface.

6. The electrical connector according to claim 1, wherein the upper edge of the connection slot of the insulation base is formed with a plurality of spaced first spacers so as to form a plurality of spaced first terminal receiving slots, and the lower edge is formed with a plurality of spaced second spacers so as to form a plurality of spaced second terminal receiving slots.

7. The electrical connector according to claim 6, wherein the contacts of the first terminals may be elastically moved in the first terminal receiving slots, and the contacts of the second terminals may be elastically moved in the second terminal receiving slots, respectively.

* * * * *